US008944633B2

(12) United States Patent
Cheng et al.

(10) Patent No.: US 8,944,633 B2
(45) Date of Patent: Feb. 3, 2015

(54) LIGHTING DEVICE RECESSIVELY MOUNTED IN A PLATFORM

(75) Inventors: Chang-Ming Cheng, New Taipei (TW); Shun-Chung Cheng, Taitung County (TW); Chih-Huang Wang, Taoyuan County (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 462 days.

(21) Appl. No.: 13/413,630

(22) Filed: Mar. 6, 2012

(65) Prior Publication Data

US 2012/0243229 A1 Sep. 27, 2012

(30) Foreign Application Priority Data

Mar. 25, 2011 (CN) ..... 2011 1 0077384

(51) Int. Cl.

| | |
|---|---|
| ***F21S 4/00*** | (2006.01) |
| ***F21S 19/00*** | (2006.01) |
| ***F21V 17/02*** | (2006.01) |
| ***F21S 8/02*** | (2006.01) |
| ***F21V 21/08*** | (2006.01) |

(52) U.S. Cl.
CPC ..... *F21V 17/02* (2013.01); *F21S 8/028* (2013.01); *F21V 21/08* (2013.01)
USPC ..... 362/249.02

(58) Field of Classification Search
USPC ..... 362/249.02
See application file for complete search history.

(56) References Cited

U.S. PATENT DOCUMENTS 5,664,957 A * 9/1997 Starr ..... 439/207

* cited by examiner

*Primary Examiner* — Joseph L Williams
(74) *Attorney, Agent, or Firm* — Li&Cai Intellectual Property (USA) Office

(57) ABSTRACT

A lighting device includes a lighting unit, a base, a lighting trim, a connecting unit, at least one pull rope, and a plurality of resilient latching members and linking members. The base and the lighting trim are disposed on respective ends of the lighting unit. The base has a receiving hole formed thereon. At least one hole is formed on a flange portion of the lighting trim and is corresponding to the at least one pull rope. The connecting unit is received by the receiving hole and connected between one end of the pull rope and the resilient latching members. The other end of the pull rope is passed through the hole. The resilient latching members are disposed around the base and corresponding to the respective linking members.

20 Claims, 13 Drawing Sheets

LIGHTING DEVICE RECESSIVELY MOUNTED IN A PLATFORM

BACKGROUND OF THE INVENTION

1. Field of the Invention

The instant disclosure relates to a lighting device; more particularly, to a lighting device that can be installed and dismounted with ease.

2. Description of Related Art

Conventional ceiling-mount lighting devices, such as recessed lights, often rely on fastening members and springs for mounting. As a result, it is troublesome for a user to install or dismount the recessed light. For example, when dismounting, the user has to insert his/her hand into the ceiling to disengage the fastening members. Therefore, a lighting device that can be installed and dismounted with ease is greatly desired.

To address the above issue, the inventor strives via industrial experience and academic research to present the instant disclosure, which can effectively improve the limitation described above.

SUMMARY OF THE INVENTION

The instant disclosure provides a lighting device to be installed and dismounted with ease.

The lighting device includes a lighting unit, a base, a lighting trim, a connecting unit, and a plurality of resilient latching members and linking members. The lighting unit is arranged between the base and the lighting trim. A receiving hole is formed on the base, and the connecting unit is received by the receiving hole. The lighting trim has a flange portion with an opening formed thereon. Light originated from the lighting unit is emitted through the opening. One end of the pull rope is connected to the connecting unit, and the other end thereof is passed through the hole and exposed therefrom. The linking members are connected between the resilient latching members and the connecting unit.

The instant disclosure also provides a lighting device to be recessively mounted in a platform, typically arranged at an elevated location such as on the ceiling. The platform is preferably formed with a mounting hole to accommodate the lighting unit of the lighting device. The resilient latching members of the lighting device are configured to establish pressing contact against a concealed surface of the platform, while the flange portion of the lighting trim of the lighting device presses against the exposed surface thereof, thereby enabling secure mounting of the lighting device to the platform upon proper installation.

The instant disclosure is advantageous in that the lighting device can be dismounted from the platform by simply pulling the pull rope. Therefore, the process of installing and dismounting the lighting device, especially when it is installed at a hard-to-reach location, such as on the ceiling, can be greatly simplified.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF PREFERRED EMBODIMENTS

For the instant disclosure, the terms "top", "bottom", "left", "right", "front", "rear", "inner", and "outer" are used with respect to each other and for explaining the appended figures only. The aforementioned terms are not used to restrict the scope of the instant disclosure.

Figure 1:
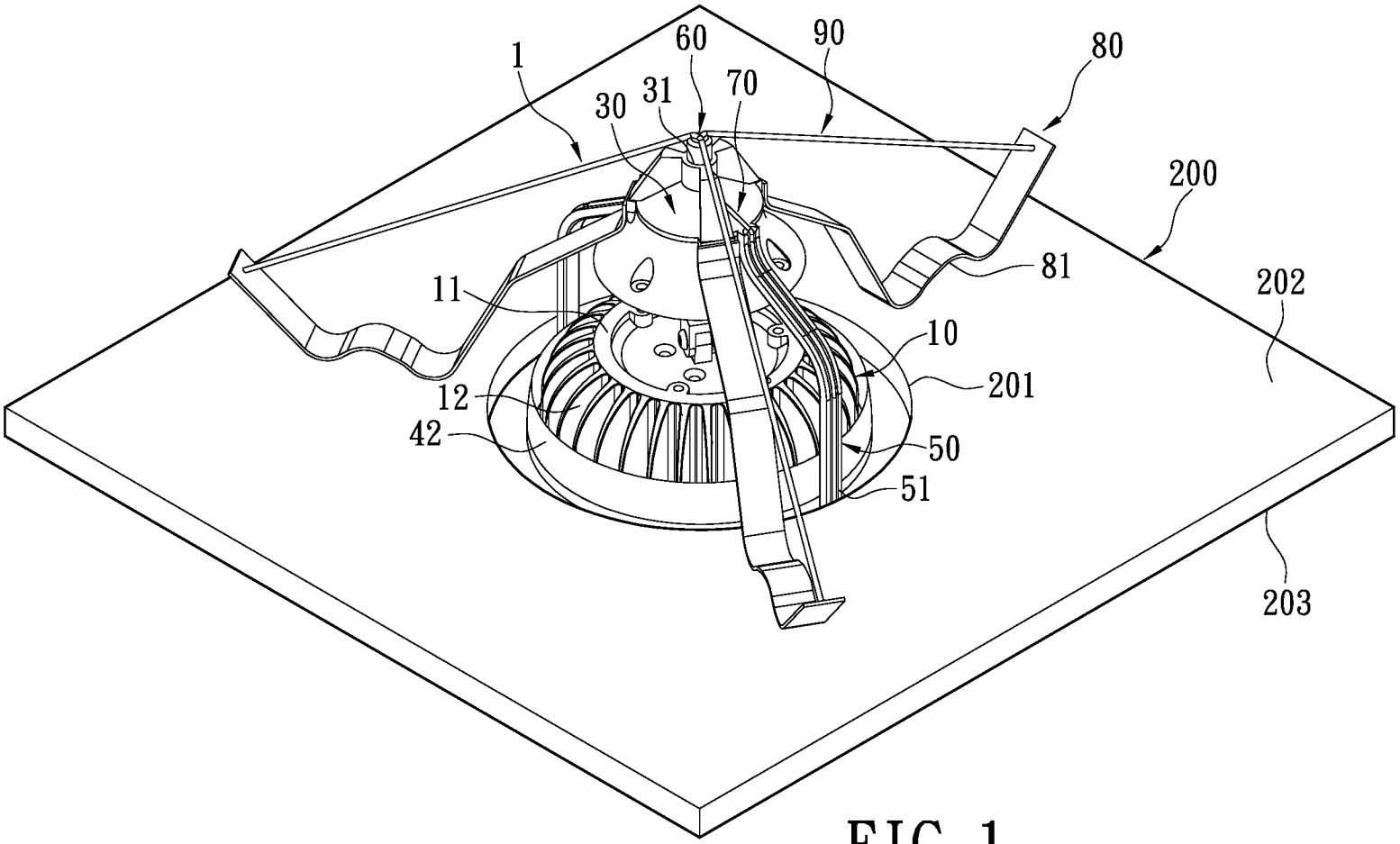
FIG. 1 is a perspective view of an exemplary lighting device installed to a platform in accordance with the instant disclosure.
Figure 2:
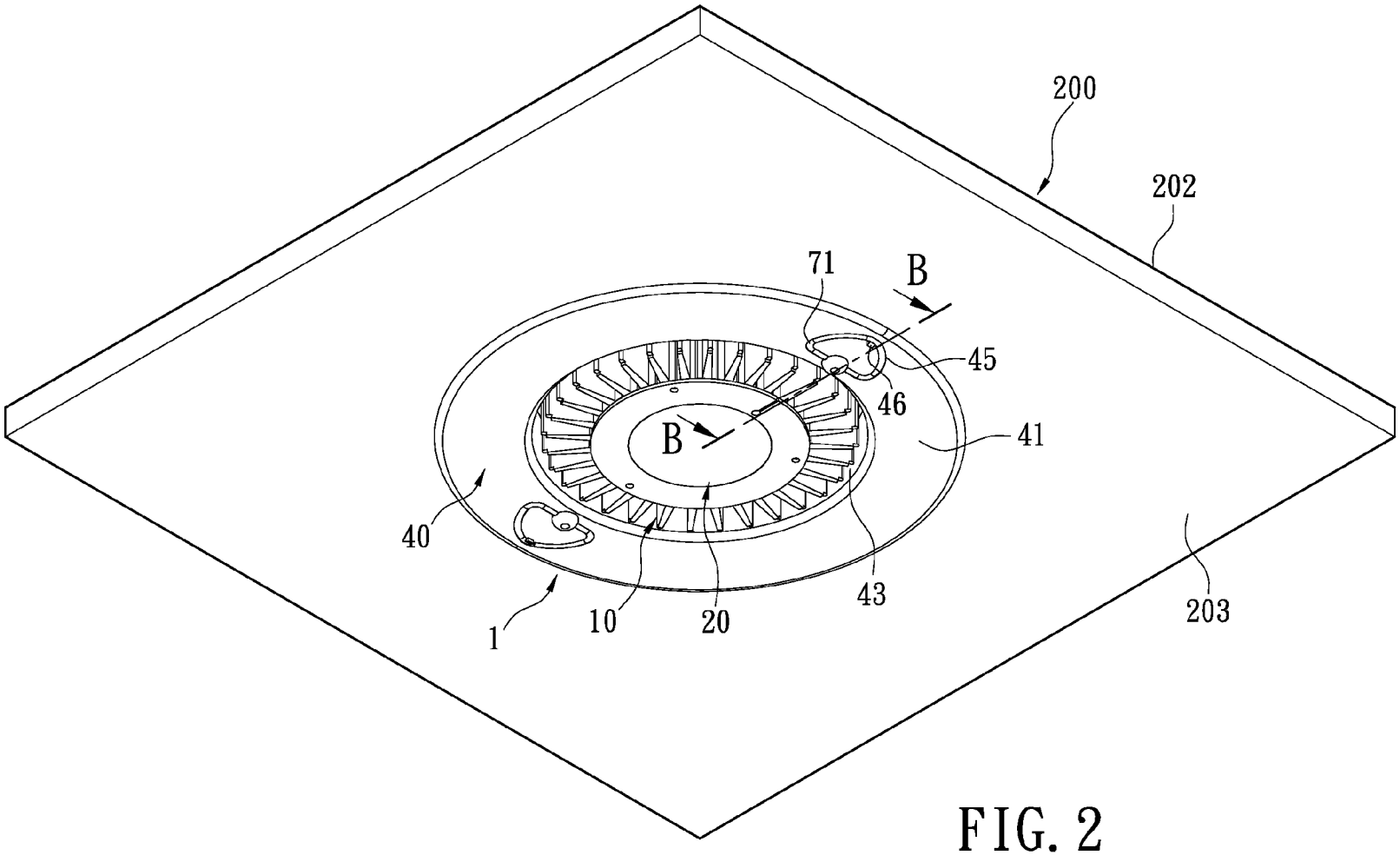
FIG. 2 is a perspective view of the exemplary lighting device installed to a platform from another angle.
Figure 5:
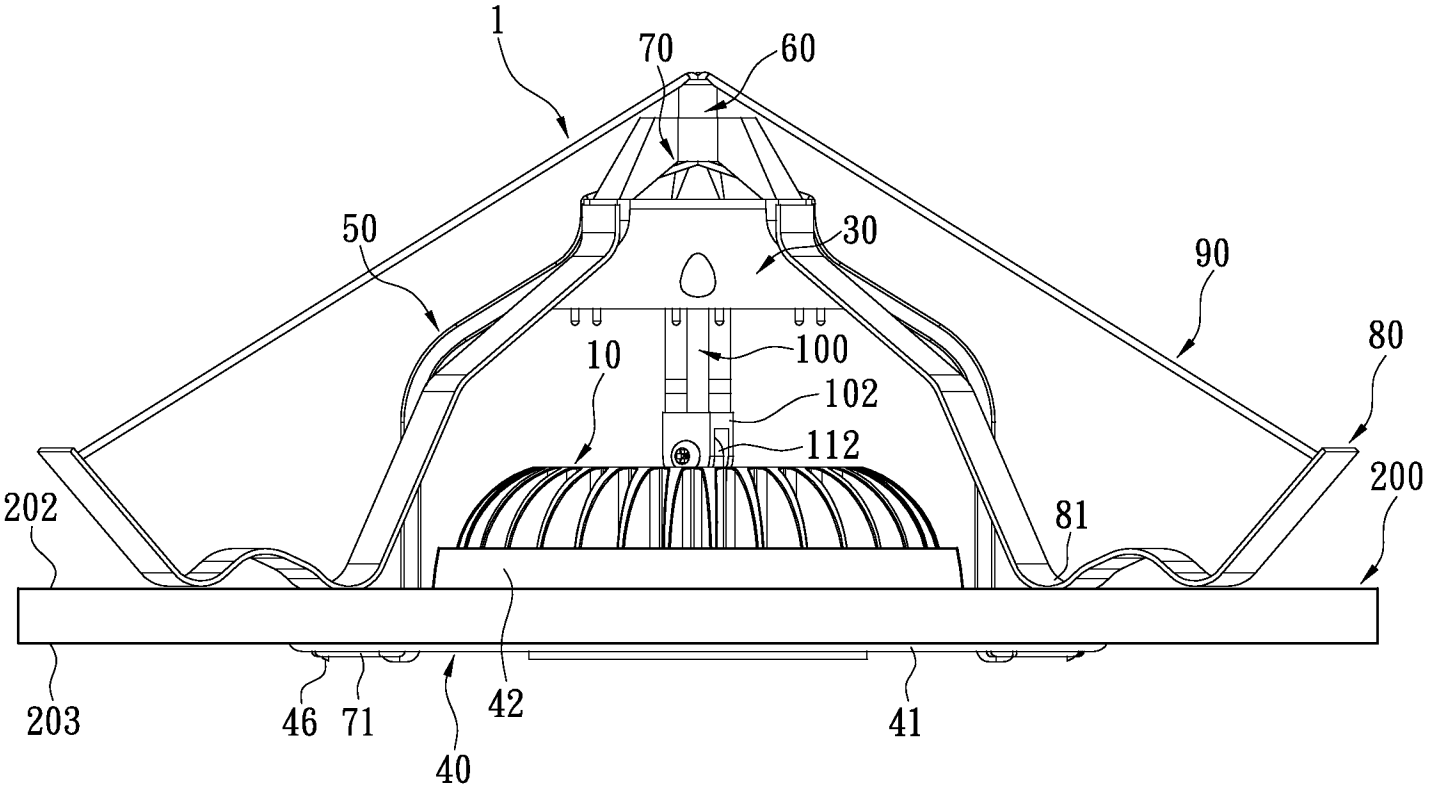
FIG. 5 is a front view of the exemplary lighting device installed to the platform.

Please refer to FIGS. 1, 2, and 5. The instant disclosure provides a lighting device 1 for installing in a platform 200. The platform 200 has a mounting hole 201 formed thereon. A typical platform 200 for mounting the instant lighting device is a ceiling, which generally has an upward concealed surface 202 (namely a concealed side) and a downward exposed surface 203 (namely an exposed side). For other embodiments, the platform 200 may be a floor, a sloped surface, a vertical wall, etc. The lighting device 1 comprises a heat sink 10, a lighting unit 20, a base 30, a lighting trim 40, a connecting unit 60, at least one pull rope 70 (there are two pull ropes in this embodiment), a plurality of resilient latching members 80 (three resilient latching members 80 are adapted in this embodiment), and a plurality of linking members 90 (three linking members are used in this embodiment).

Figure 3:
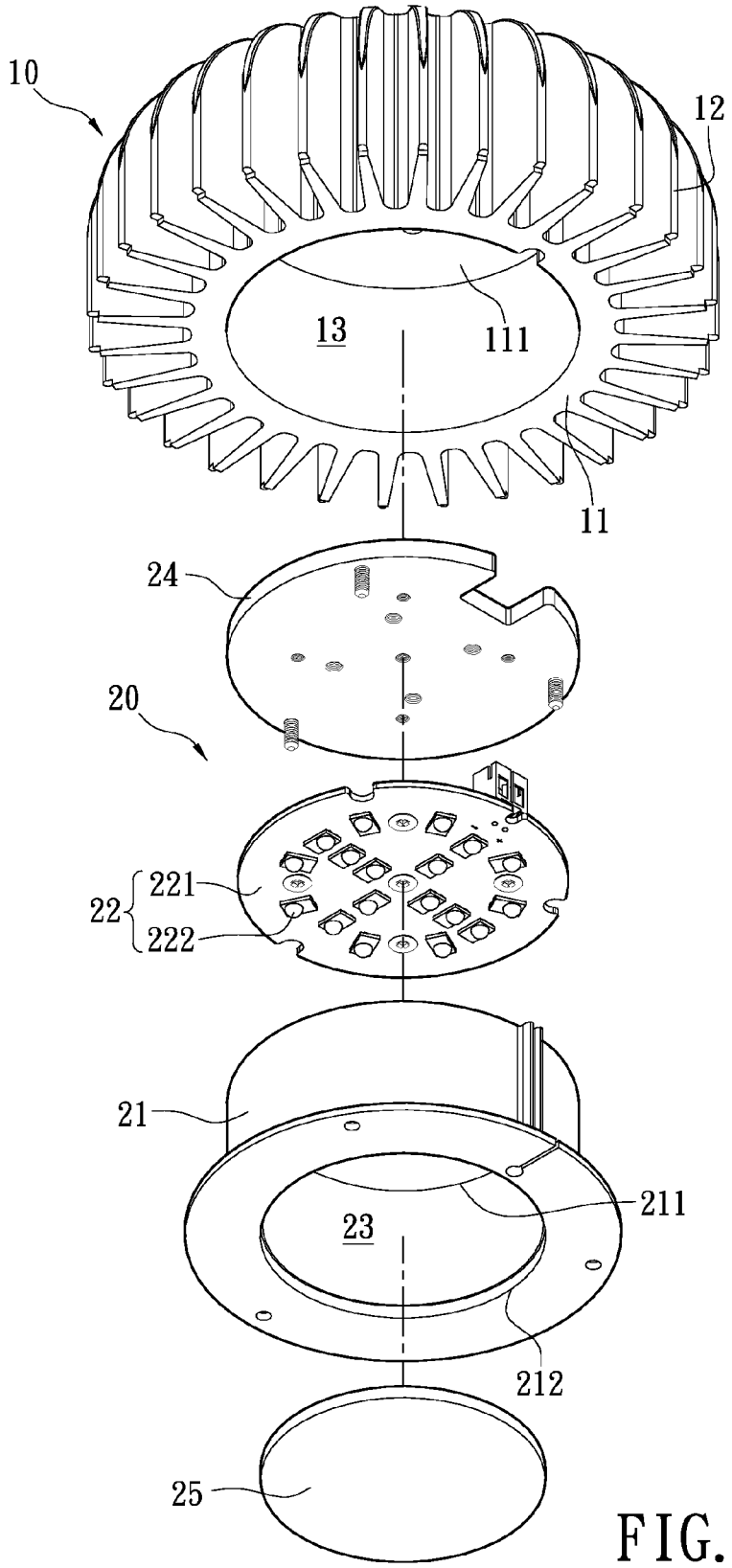
FIG. 3 is an exploded view of a heat sink and a lighting unit of the exemplary lighting device in accordance with the instant disclosure.
Figure 4:
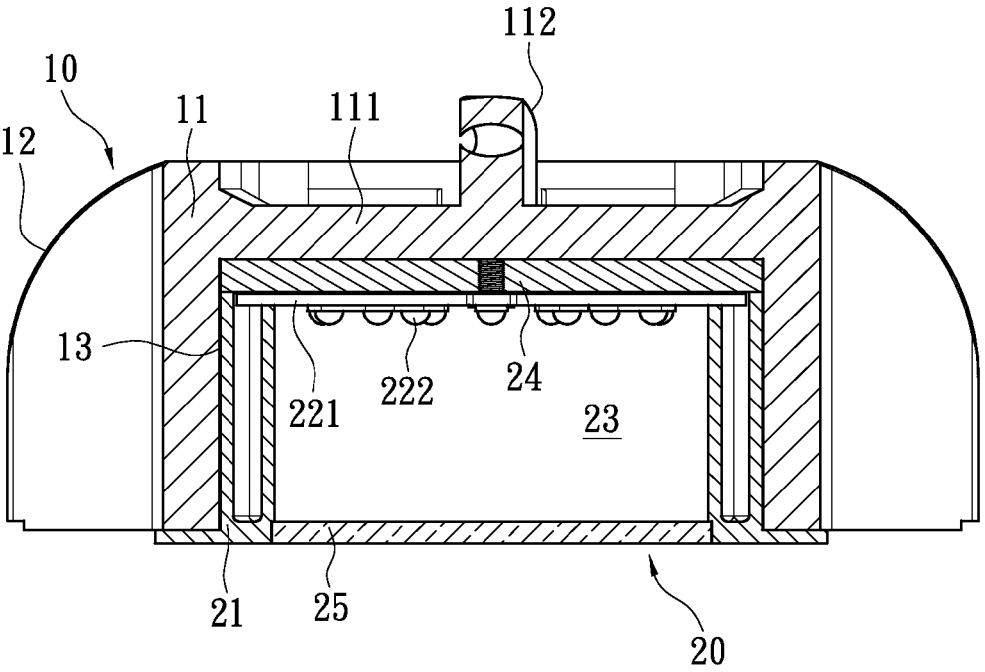
FIG. 4 is a sectional view of the heat sink and the lighting unit of the exemplary lighting device in accordance with the instant disclosure.

Please refer to FIGS. 3 and 4. Made of heat-conducting metal, the heat sink 10 has a radiating main body 11 and a plurality of heat-dissipating fins 12 radially arranged on the side wall thereof. A recess 13 is formed centrally on one end of the radiating main body 11, i.e., the bottom end. A back plate 111 is formed on an opposite end of the radiating main body 11, i.e., the top end. A first pivoting portion 112 is upward protruded from the back plate 111.

The lighting unit 20 is received by the heat sink 10. The lighting unit 20 includes a tube-shaped member 21, a support plate 24, a light-emitting module 22, and a lens 25. The tube-shaped member 21 is made of heat-conducting metal, which is inserted into the recess 13 of the heat sink 10. A cavity 23 is formed on the tube-shaped member 21. A first assembling hole 211 and a second assembling hole 212 are formed on a top end and a bottom end of the tube-shaped member 21, respectively. The first and second assembling holes 211, 212 face each other oppositely and enable communication with the cavity 23.

The support plate 24 is disposed over the first assembling hole 211 of the tube-shaped member 21 and abutted against the back plate 111 of the radiating main body 11. The light-emitting module 22 is received by the cavity 23. The light-emitting module 22 includes a circuit board 221 and a plurality of light-emitting diodes (LEDs) 222 disposed thereon. The circuit board 221 is disposed against the support plate 24. The lens 25 is made of light-permitting material and disposed over the second assembling hole 212 of the tube-shaped member 21.

Figure 6:
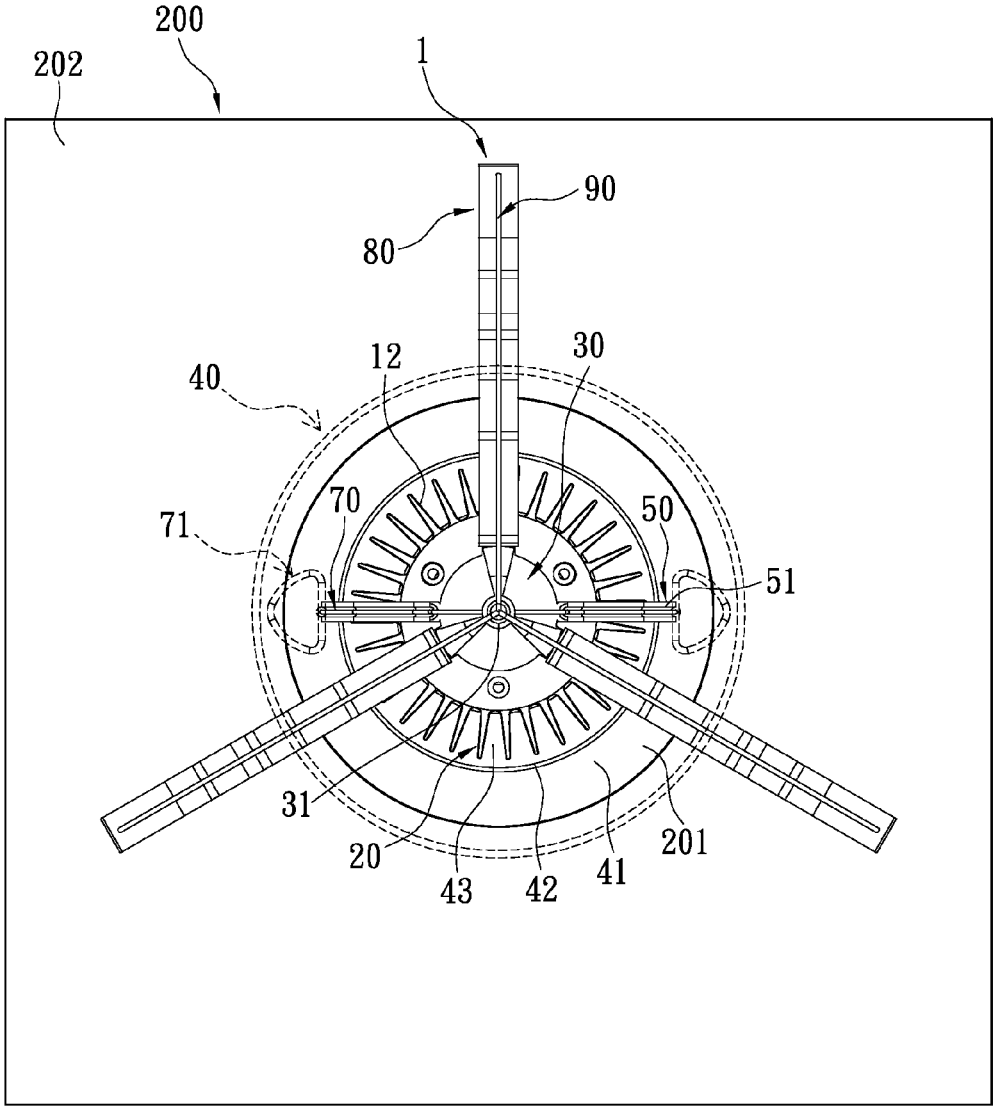
FIG. 6 is a top view of the lighting device installed in the platform.

Please refer to FIG. 6 in conjunction with FIG. 5. An adjustable support structure 100, whose detail will be discussed in a later section, is disposed between the heat sink 10 and the base 30 for maintaining the base 30 above the heat sink 10 and the lighting unit 20 by a desirable distance. A receiving hole 31 is formed axially on the top end of the base 30 to accommodate the connecting unit 60. The outer surface of the base 30 is formed with at least one guiding rail 50. The guiding rail 50 has a rail slot 51 formed thereon extending along the guiding rail 50 to the two opposing ends thereof.

The lighting trim 40 is disposed beneath the heat sink 10 and the lighting unit 20. Particularly, the lighting trim 40 in this embodiment is of a recessed design, and has a disc-shaped flange portion 41 adapted for establishing pressing contact against the exposed surface 203 of the platform 200 upon installation of the lighting device 1. The lighting trim 40 substantially resembles a hollow rim-like housing having a surrounding side wall 42. The surrounding side wall 42 defines an opening 43, which exposes the lighting unit 20 and the heat sink 10 received therein (see FIG. 2). Thus, the light originated from the light-emitting module 22 can be emitted through the opening 43 via the lens 25. The surrounding side wall 42 may contribute to shield the heat sink 10 partially, thus preventing users from seeing behind the mounting platform 200 through the opening 43. The guiding rail 50 extends from the base 30 to the concealed surface 202 of the flange portion 41 of the lighting trim 40. A hole 44 (FIG. 13) is formed on the flange portion 41 of the lighting trim 40 in correspondence to the rail slot 51. In other words, the hole 44 enables communication to one end of the corresponding rail slot 51.

The connecting unit 60 is received by the receiving hole 31 of the base 30 along the axial direction. The pull rope 70 is made from metallic materials, such as a steel rope. The pull rope 70 is rested in the rail slot 51 along the guiding rail 50. Therefore, the numbers of the pull rope 70 and the guiding rail 50 are equal. More specifically, one end (top end) of the pull rope 70 is connected to the connecting unit 60, and the opposite end (bottom end) thereof is connected to a ring-pull 71 by passing through the hole 44. In this embodiment, two guiding rails 50 and two pull ropes 70 are illustrated for explaining purposes. The guiding rails 50 are disposed on respective sides of the heat sink 10 oppositely. Other variations may include a single guiding rail 50 and a single pull rope 70 only, or adopting three guiding rails 50 with three pull ropes 70.

The instant embodiment utilizes three resilient latching members 80 substantially evenly distributed around the base 30. Each of the resilient latching members 80 has a flexible strip plate body preferably made of metallic material. The resilient latching members 80 are arranged on the base 30 extending substantially radially outward. The resilient latching members 80 are configured to cooperatively latch on the concealed surface 202 of the platform 202 and are capable of achieving secure mounting upon installation. In particular, a curved abutting portion 81 is formed at the middle portion of each resilient latching member 80. In this embodiment, the abutting portion 81 is approximately W-shaped, which provides two contacting areas against the concealed surface 202 of the platform 200. For other embodiments, the abutting portions 81 can be shaped differently. For example, each abutting portion 81 can have one or more bends to abut against the concealed surface 202 of the mounting platform 200 for securing the lighting device 1.

The linking members 90 can be ropes, chains, wire ropes, metal cables, or other flexible connectors processing suitable tensile strength for the instant disclosure. The linking members 90 are connected between the resilient latching members 80 and the connecting unit 60. The number of the linking member 90 and the resilient latching member 80 are the same. In this embodiment, three resilient latching members 80 and three linking members 90 are illustrated.

Figure 7:
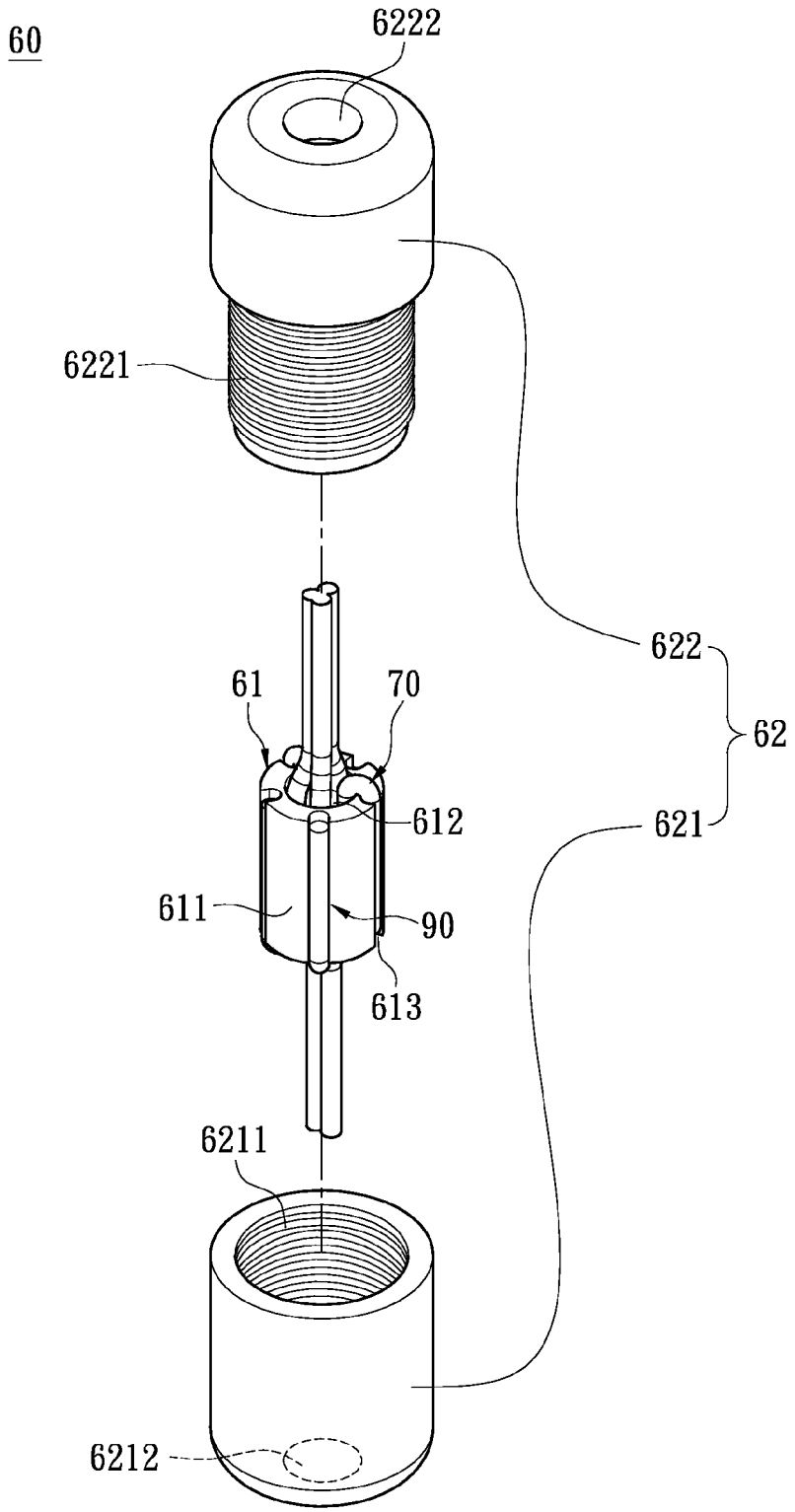
FIG. 7 is an exploded view of a connecting unit of the exemplary lighting device in accordance with the instant disclosure.
Figure 8:
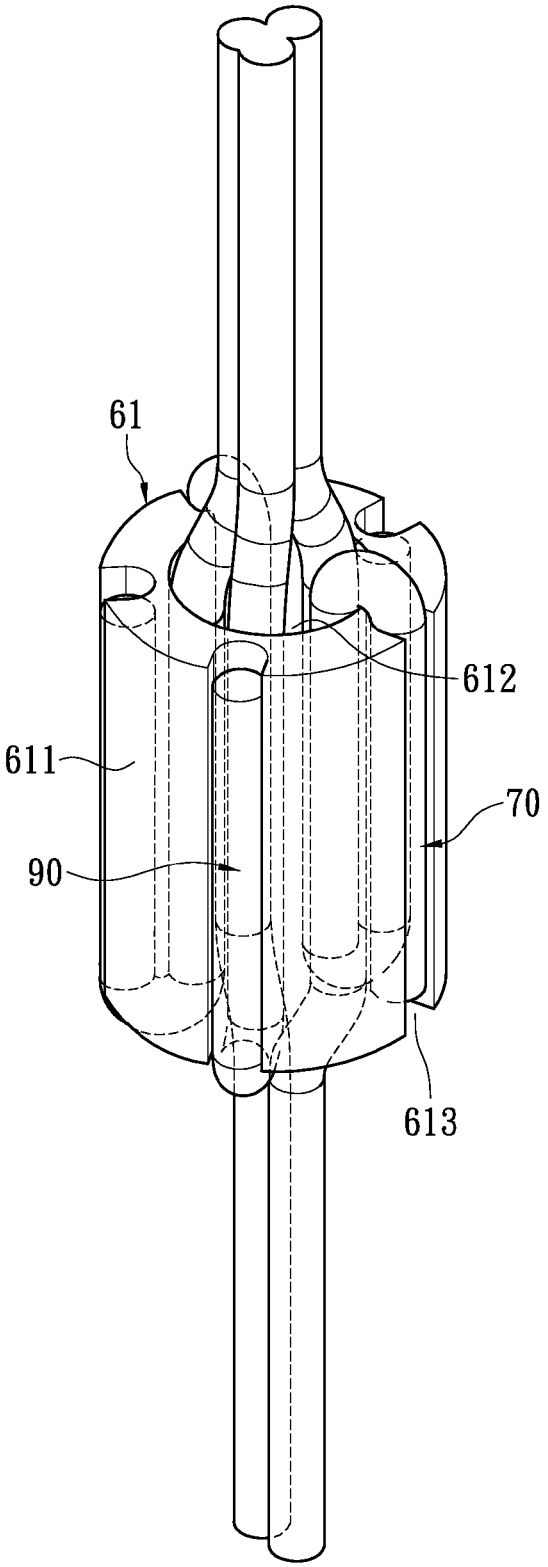
FIG. 8 is an assembled view of a coupling sleeve, a pull rope, and linking members of the exemplary lighting device in accordance with the instant disclosure.
Figure 9:
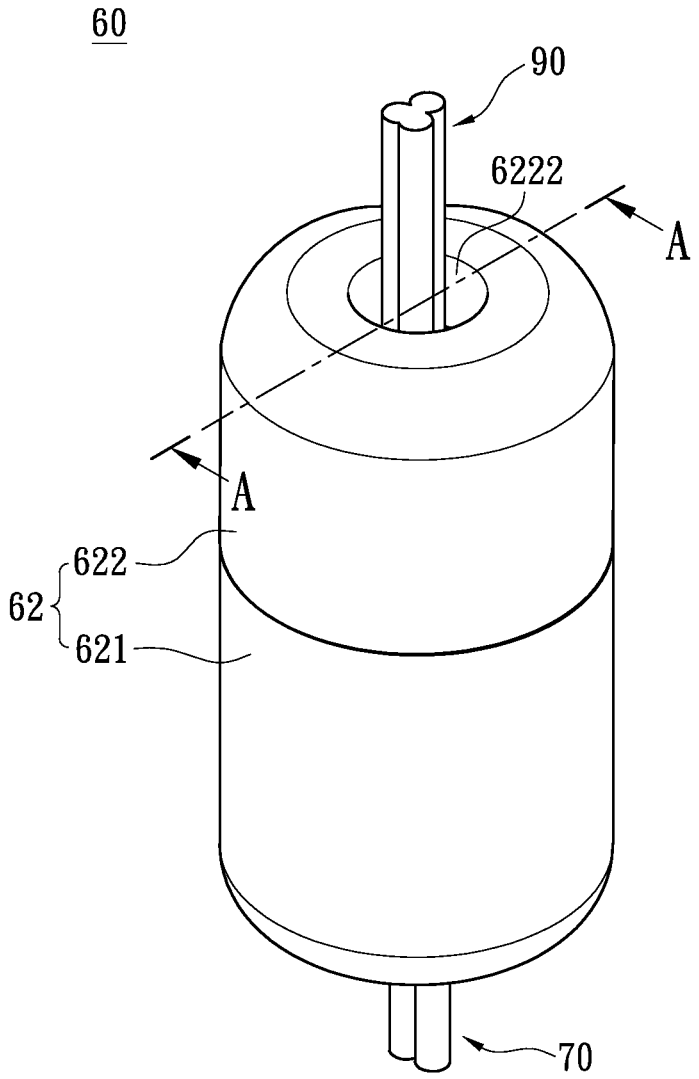
FIG. 9 is an assembled view of the connecting unit of the exemplary lighting device in accordance with the instant disclosure.

Please refer to FIGS. 7 to 9. The connecting unit 60 includes a coupling sleeve 61 and a holder 62. The coupling sleeve 61 has a main portion 611 with a thru hole 612 and a plurality of grooves 613 formed thereon. The thru hole 612 is projected axially through the main portion 611, and the grooves 613 run along the axial direction of the main portion 611 and are arranged annularly on the outer surface thereof. The coupling sleeve 61 is utilized for coupling the pull ropes 70 and the linking members 90. In this embodiment, five grooves 613 are illustrated. Two grooves 613 are for the two pull ropes 70, while the other three grooves 613 are for the three linking members 90. The pull ropes 70 and the linking members 90 are arranged through the thru hole 612 and secured to the corresponding grooves 613. The pull ropes 70 first pass from the bottom end of the main portion 611 to the top end thereof via the thru hole 612. Then, the pull ropes 70 are directed back toward the bottom end of the main portion 611 and secured in the corresponding grooves 613. Conversely, the linking members 90 first pass from the top end of the main portion 611 to the bottom end thereof via the thru hole 612. Then, the linking members 90 are directed back toward the top end of the main portion 611 and secured in the corresponding grooves 613.

Figure 10:
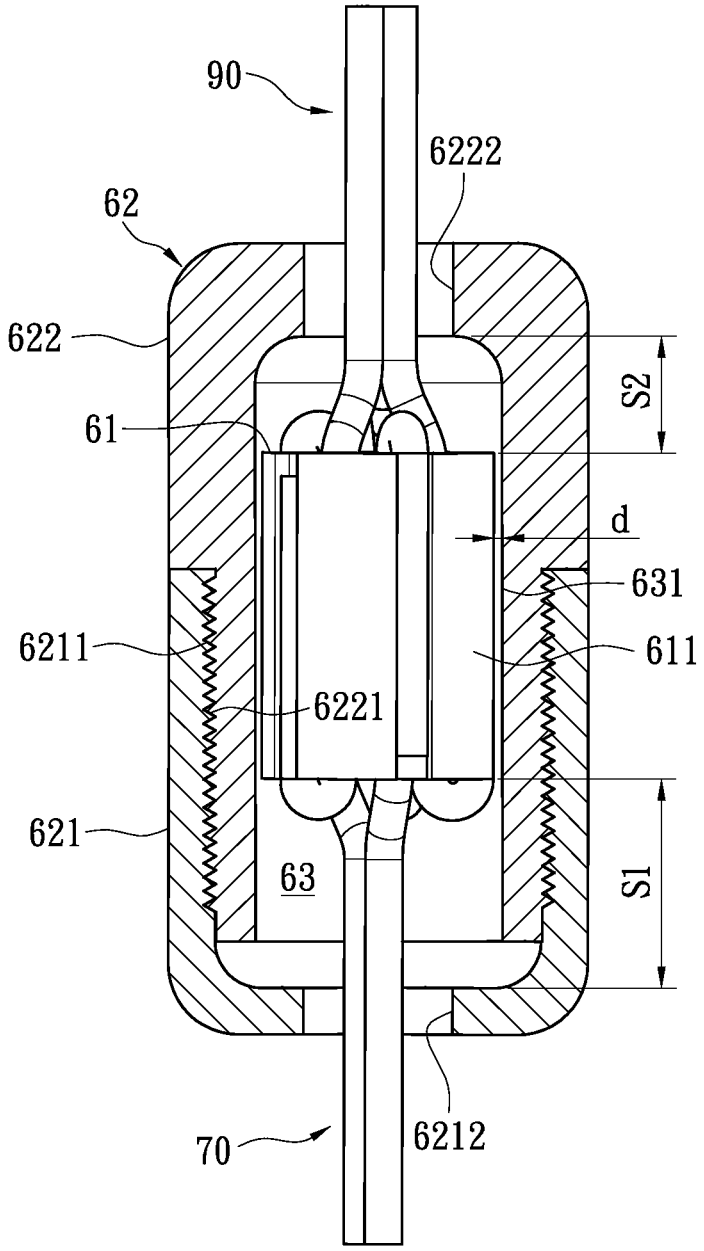
FIG. 10 is a cross-sectional view of the connecting unit of FIG. 9 taken along the line A-A.

Please refer to FIG. 10. A receiving compartment 63 is formed inside the holder 62. Being enclosed by the holder 62, the coupling sleeve 61 can move upward or downward along its axial direction in the receiving compartment 63. Preferably, a clearance d, such as 0.01 mm, is formed between the main portion 611 and an inner wall 631 of the receiving compartment 63.

In this embodiment, the holder 62 includes a first shell 621 and a second shell 622. The first shell 621 is hollowed and having a first aperture 6212 formed on one end (the bottom end) thereof. The pull ropes 70 pass through the first aperture 6212 and enter the receiving compartment 63. For the opposite end (the top end) of the first shell 621, a first threaded portion 6211 is formed therein. The second shell 622 is also hollowed and having a second aperture 6222 formed on the top end thereof. The linking members 90 pass through the second aperture 6222 and enter the receiving compartment 63. For the opposite end (bottom end) of the second shell 622, a second threaded portion 6221 is formed thereon. The second threaded portion 6221 is mated to the first threaded portion 6211 to assemble the first shell 621 with the second shell 622. In addition, the bottom end of the main portion 611 is spaced from the bottom end of the first shell 621, i.e. the position of the first aperture 6212, by a distance S1. The top end of the main portion 611 is spaced from the top end of the second shell 622, i.e. the position of the second aperture 6222 by a distance S2. The distances S1 and S2 provide room for the coupling sleeve 61 to travel up and down inside the receiving compartment 63. Due to the elasticity of the resilient latching members 80, the coupling sleeve 61 would return automatically to its home position after the pull ropes 70 are released.

Please refer back to FIGS. 1, 2, and 5. After the lighting device 1 is mounted to the platform 200, the lighting unit 20 and the heat sink 10 are received by the mounting hole 201 of the platform 200. The abutting portions 81 of the resilient latching members 80 abut to the concealed surface 202 of the platform 200. The flange portion 41 of the lighting trim 40 abuts the exposed surface 203 of the platform 200. Thus, the lighting device 1 can be securely mounted to the platform 200.

Figure 11:
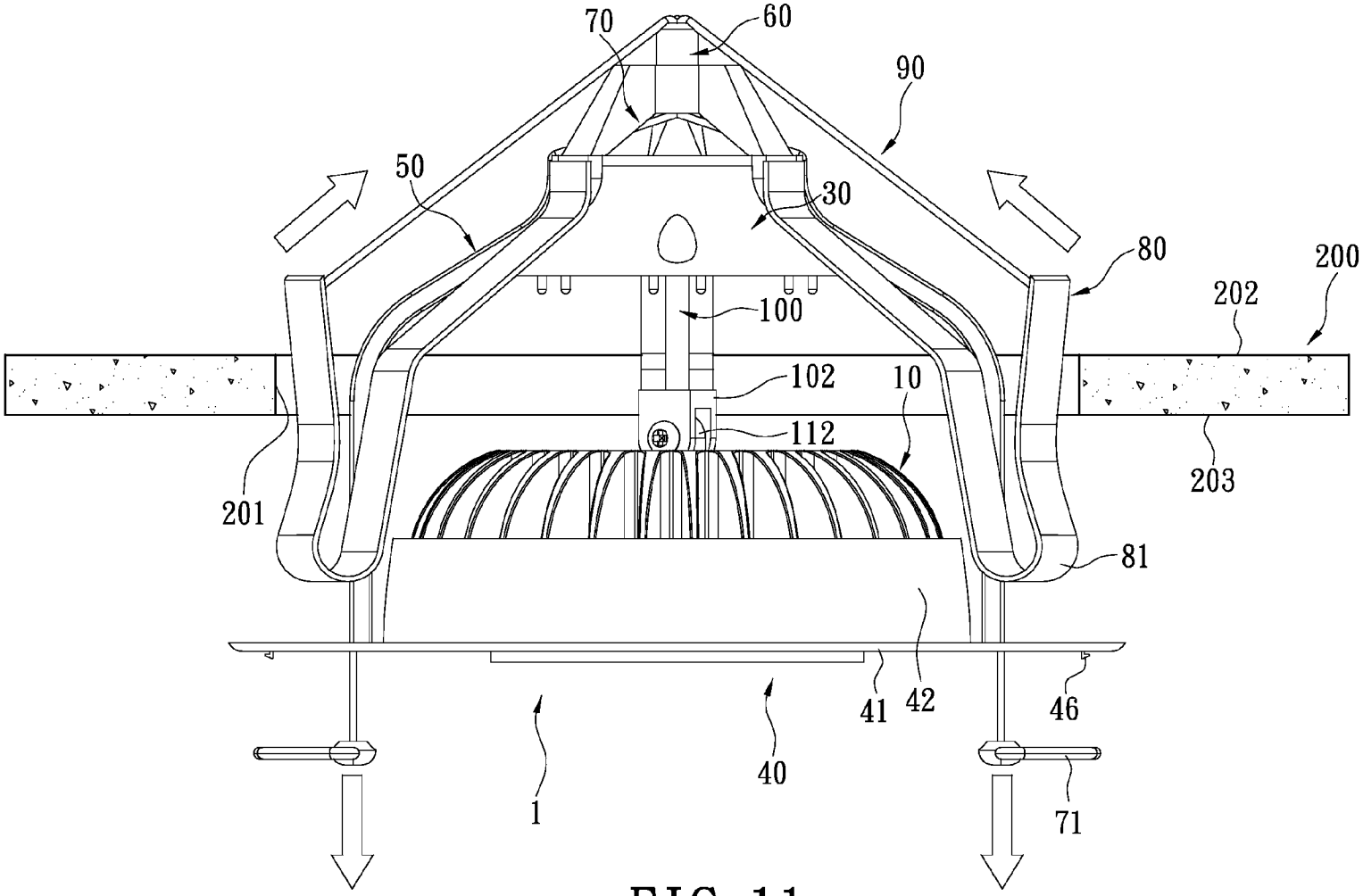
FIG. 11 is a side illustration of the dismounting of the exemplary lighting device from the platform.

Please refer to FIGS. 10 and 11. When the user wants to remove the lighting device 1 off the platform 200, the user only needs to use the ring-pulls 71 and pull the pull ropes 70 downward. When the pull ropes 70 are pulled, the coupling sleeve 61 is biased downward inside the receiving compartment 63 by a certain distance (or abutting against the first aperture 6212 of the first shell 621). Portions of the linking members 90 are pulled into the holder 62, thus bringing each resilient latching member 80 to bend toward the base 30 into a U-shaped structure. Thus, the resilient latching members 80 no longer press against the concealed surface 202 of the platform 200. In addition, by pulling back the resilient latching members 80 from the originally extended state, the lighting device 1 can be removed from the mounting hole 201 unobstructedly with ease.

Conversely, when installing the lighting device 1, the user again pulls on the ring-pulls 71 to pull the pull ropes 70 downward. Like before, the resilient latching members 80 would bend toward the base 30. The resilient latching members 80 were held back to allow the lighting device 1 to pass through the mounting hole 201 of the platform 200. As the pull ropes 70 are released, the resilient latching members 80 are released from the external pulling force, and thus allowed to return to its initial extended state. In the mean time, the linking members 90 are pulled out of the holder 62 by the resilient latching members 80, wherein the coupling sleeve 61 is displaced upward inside the receiving compartment 63 by a certain distance (or abutting against the second aperture 6222 of the second shell 622). Thus, the resilient latching members 80 are returned to its original structural state (curved/extended). At such moment, the abutting portions 81 of the resilient latching members 80 and the flange portion 41 of the lighting trim 40 presses against the concealed and the exposed surfaces 202, 203 of the platform 200, respectively. Thus, the lighting device 1 can be securely and conveniently installed.

The clearance d between the coupling sleeve 61 and the inner wall 631 of the receiving compartment 63 may effectively reduce the friction exerted on the coupling sleeve 61. When the pull ropes 70 are initially pulled downward, the coupling sleeve 61 and the linking members 90 are displaced downward correspondingly inside the receiving compartment 63. More specifically, when the pull ropes 70 are pulled, the coupling sleeve 61 is displaced downward by a certain distance, namely S1+S2, to abut against the bottom portion of the holder 62, i.e. contacting the first aperture 6212 of the first shell 621. The displaced coupling sleeve 61 also drags the holder 62 downward as well. Once the pull ropes 70 are released, the elasticity of the resilient latching members 80 enables the coupling sleeve 61 to displace upward by the distance of S1+S2. Thus, the coupling sleeve 61 is returned to its home position by abutting against the top portion of the holder 62, i.e. contacting the second aperture 6222 of the second shell 622. Such state is matched by the abutting portions 81 pressing against the platform 200.

Figure 12:
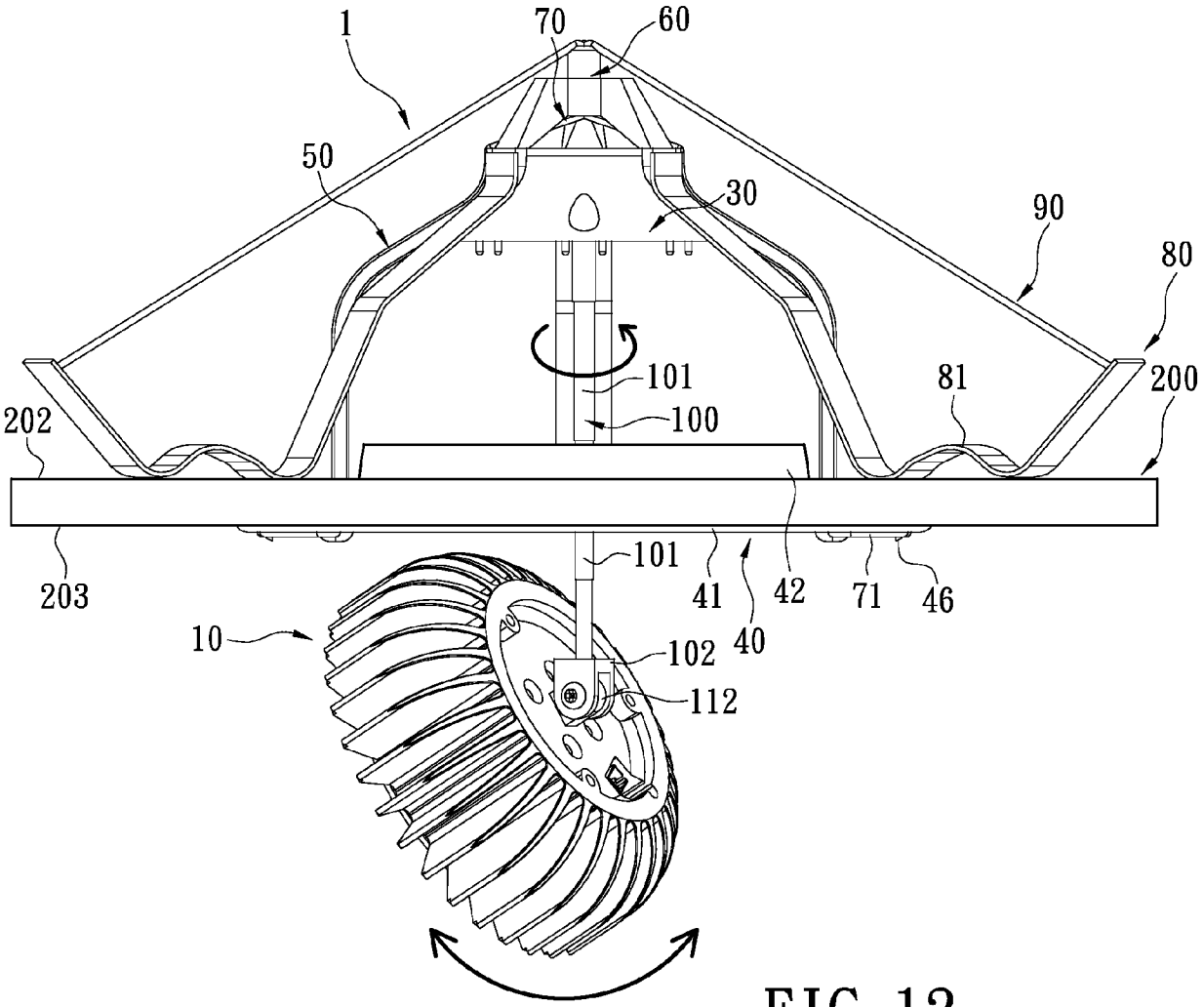
FIG. 12 is a side illustration of the exemplary lighting device when the support member thereof is extended.

Please refer to FIGS. 11 and 12 which show the length adjustment operation of the support structure 100 disposed between the heat sink 10 and the base 30. The support structure 100 has a plurality of tubular members 101, which are disposed retractably or extendably with respect to each other. Thus, the vertical position of the lighting unit 20 of the lighting device 1 can be adjusted by extending or retracting the support structure 100.

More specifically, one end (top end) of the support structure 100 is rotatably disposed on the bottom end of the base 30. Thus, the heat sink 10 and the lighting unit 20 can be revolved around the axial direction of the support structure 100, or rotate in a parallel manner with respect to the platform 200. A second pivoting portion 102 is disposed on an opposite end (lower end) of the support structure 100. The second pivoting portion 102 can be pivotally connected to the first pivoting portion 112 of the heat sink 10 (FIG. 12). Thus, the light projecting angle of the lighting unit 20 can be adjusted with respect to the platform 200. By being both rotatable and pivotable, the lighting device 1 can be adjusted position-wise to change the lighting angle. With such capability, the lighting device 1 possesses the functions of a track light and a spot light. Therefore, the multi-functional lighting device 1 can be adapted to a wide range of applications.

Figure 13:
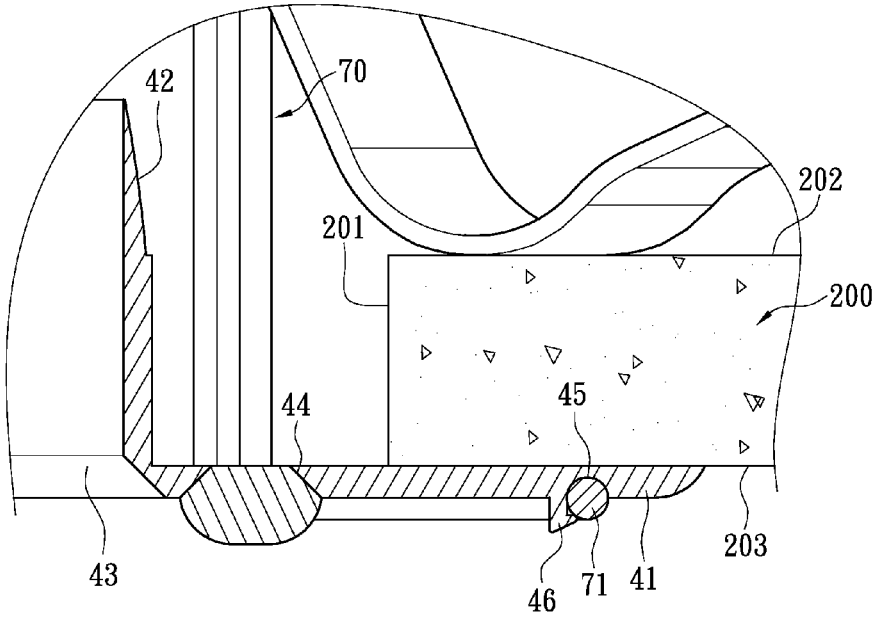
FIG. 13 is a cross-sectional enlargement view of the exemplary lighting device of FIG. 2 taken along the line B-B.

Please refer to FIGS. 2 and 13. At least one ring-pull holding groove 45 may be formed on the flange portion 41 of the lighting trim 40 to respectively retain the at least one ring-pull 71. A securing member 46 may be further formed on one side of each holding groove 45. Once the lighting device 1 has been installed, the ring-pulls 71 can be received by the holding grooves 45 and be held in place by the securing members 46. Thus, the ring-pulls 71 do not hang loosely.

Based on the above descriptions, the lighting device of the instant disclosure can be installed or dismounted by pulling on the pull ropes. The installing and dismounting procedures have been effectively simplified.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A lighting device, comprising:

a lighting unit having a light-emitting module;

a base having a receiving hole formed thereon;

a lighting trim having a flange portion, wherein the lighting unit is arranged between the base and the lighting trim, an opening is defined on the flange portion for allowing light to be emitted from the light-emitting module, and at least one hole is formed on the flange portion;

a connecting unit received by the receiving hole of the base;

at least one pull rope, one end of the pull rope being connected to the connecting unit, the other end of the pull rope being arranged through the hole;

a plurality of resilient latching members disposed on the base; and a plurality of linking members corresponding to the respective resilient latching members, the linking members being connected between the resilient latching members and the connecting unit.

2. The lighting device of claim 1, further comprising at least one guiding rail formed on the base, the guiding rail having a rail slot extending toward the flange portion and communicating with a corresponding hole, wherein the pull rope is disposed in the rail slot of the guiding rail.

3. The lighting device of claim 1, wherein the connecting unit includes a coupling sleeve and a holder, a receiving compartment is formed inside the holder, the coupling sleeve has a main portion and is movably received within the receiving compartment, a thru hole and a plurality of grooves are formed on the main portion, the thru hole and the grooves pass axially through the main portion, and the pull rope and the linking members are formed through the thru hole and secured to the respective grooves.

4. The lighting device of claim 3, wherein the grooves are concavely formed on an outer surface of the main portion and arranged annularly thereon.

5. The lighting device of claim 3, wherein a clearance is formed between the main portion of the coupling sleeve and an inner wall of the receiving compartment.

6. The lighting device of claim 3, wherein the holder includes a first shell and a second shell, a first aperture and a first threaded portion are formed on the first shell, the pull rope is passed through the first aperture, a second aperture and a second threaded portion are formed on the second shell, the linking members is passed through the second aperture, and the second threaded portion is mated to the first threaded portion.

7. The lighting device of claim 1, further comprising a heat sink partially exposed from the opening of the flange portion, wherein the lighting unit is received by the heat sink, and each resilient latching member are arranged on the base extending substantially radially outward.

8. The lighting device of claim 7, further comprising a support structure disposed between the heat sink and the lighting unit, wherein the support structure has a plurality of tubular members and the tubular members are disposed extendably and retractably with respect to each other.

9. The lighting device of claim 7, further comprising a support structure disposed between the heat sink and the base, wherein one end of the support structure is rotatably disposed on the base, and the other end of the support structure pivotally connects the lighting unit.

10. The lighting device of claim 7, wherein a surrounding side wall is formed around the opening of the flange portion, and the surrounding side wall (42) surrounds the heat sink.

11. The lighting device of claim 7, wherein the lighting unit further includes a tube-shaped member, and a support plate, a cavity is formed in the tube-shaped member, a first assembling hole and a second assembling hole are formed on respective ends of the tube-shaped member for enabling communication to the cavity, the first assembling hole is covered by the support plate (24), the light-emitting module is disposed in the cavity, and the light-emitting module has a circuit board disposed on the support plate and a plurality of light-emitting diodes disposed on the circuit board.

12. The lighting device of claim 11, wherein the heat sin has a radiating main body and a plurality of heat-dissipating fins disposed annularly thereon, a recess is formed on one end of the radiating main body, a back plate is formed on the other end of the radiating main body, and the tube-shaped member is accommodated by the recess with the back plate being abutted by the support plate.

13. The lighting device of claim 1, further comprising a ring-pull connected to the other end of the pull rope) and a holding groove formed on the flange portion of the lighting trim for correspondingly retaining the ring-pull, wherein a securing member is formed on one side of the holding groove (45), and the ring-pull is removably received in the holding groove (45) and secured by the securing member.

14. A lighting device for recessed installation in a platform having a mounting hole, comprising:

a lighting unit;

a base disposed above the lighting unit (20) and having a receiving hole being formed thereon;

a lighting trim arranged around the lighting uni and having a flange portion, wherein an opening is formed on the flange portion to expose the lighting unit, and at least one hole is formed on the flange portion;

a connecting unit received by the receiving hole of the base;

at least one pull rope having one end connected to the connecting unit and the other end extended from the platform through the hole; a plurality of resilient latching members disposed on the base, wherein an abutting portion is formed on each resilient latching member; and a plurality of linking members corresponding to respective resilient latching members, the linking members being connected between the resilient latching members and the connecting unit; when the lighting unit is received by the mounting hole of the platform, the abutting portions of the resilient latching members press against an concealed surface of the platform, and the flange portion of the lighting trim abuts against a exposed surface of the platform.

15. A lighting device for recessed mounting in a platform having a mounting hole, comprising:

a lighting unit having a light-emitting module exposedly arranged in the mounting hole of the platform;

a flange portion arranged around the light emitting module for establishing pressing contact with an exposed side of the platform;

a base in supportive connection with the lighting unit arranged on a concealed side of the platform;

a plurality of resilient latching members arranged on the base extending substantially radially outward and configured to latch on the concealed side of the platform around the mounting hole thereof for retaining the lighting device thereto; and a plurality of linking members respectively having a connecting end connecting the respective resilient latching members, and an operable end arranged operably exposed on the exposed side of the platform;

wherein the resilient latching members unlatch from the platform by the pulling of the operable end of the linking member.

16. The lighting device of claim 15, wherein the linking member includes a pull rope coupled thereto through a connecting unit, the connecting unit includes a coupling sleeve for coupling the pull rope to the linking member, and the number of the pull rope and the number of the linking member are not identical.

17. The lighting device of claim 15, wherein the coupling sleeve is slidably arranged in the connecting unit with a predetermined gap between an inner side wall thereof.

18. The lighting device of claim 15, further comprising a guiding rail arranged on the base for guiding the pull rope.

19. The lighting device of claim 18, wherein the base includes a receiving hole arranged in a direction substantially toward the lighting unit, and the connecting unit is arranged in the receiving hole.

20. The lighting device of claim 15, wherein the lighting unit and the base are connected by an adjustable support structure.

* * * * *